US010883421B2

(12) United States Patent
Onigata et al.

(10) Patent No.: US 10,883,421 B2
(45) Date of Patent: Jan. 5, 2021

(54) ACTUATOR OF VARIABLE COMPRESSION RATIO MECHANISM AND ACTUATOR OF LINK MECHANISM

(71) Applicant: HITACHI AUTOMOTIVE SYSTEMS, LTD., Hitachinaka (JP)

(72) Inventors: Junichiro Onigata, Atsugi (JP); Yoshihiko Yamada, Fujisawa (JP); Kishiro Nagai, Atsugi (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 406 days.

(21) Appl. No.: 15/715,385

(22) Filed: Sep. 26, 2017

(65) Prior Publication Data

US 2018/0016975 A1 Jan. 18, 2018

Related U.S. Application Data

(63) Continuation of application No. 14/613,035, filed on Feb. 3, 2015, now Pat. No. 9,797,307.

(30) Foreign Application Priority Data

Feb. 4, 2014 (JP) ..... 2014-018992

(51) Int. Cl.
*F02D 15/04* (2006.01)
*F02B 75/04* (2006.01)
*F02D 15/02* (2006.01)

(52) U.S. Cl.
CPC ..... *F02B 75/045* (2013.01); *F02D 15/02* (2013.01); *Y10T 74/2151* (2015.01)

(58) Field of Classification Search
USPC ..... 123/48 R, 48 B, 78 R, 78 E, 78 F, 78 B, 123/78 BA, 197.1, 197.4, 197.3
See application file for complete search history.

(56) References Cited

U.S. PATENT DOCUMENTS 6,375,436 B1 4/2002 Irie et al.
6,494,798 B1 12/2002 Onogi
(Continued)

FOREIGN PATENT DOCUMENTS

JP S60-125454 A 7/1985
JP 2003-328794 A 11/2003
(Continued)

OTHER PUBLICATIONS

Notice of Allowance dated Jul. 13, 2016 as issued in corresponding U.S. Appl. No. 14/613,079.
(Continued)

*Primary Examiner* — George C Jin
*Assistant Examiner* — Teuta B Holbrook
(74) *Attorney, Agent, or Firm* — Foley & Lardner LLP

(57) ABSTRACT

An actuator of a variable compression ratio mechanism includes: a control link; an arm link; a control shaft; a housing including a receiving portion in which a connection portion between the second end portion of the control link and the arm link is received, and a support hole formed within the housing, and rotatably supporting the control shaft; and a speed reduction device, the control shaft including a fixing portion inserted and fixed within the receiving portion in a fixing hole formed in the arm link at a predetermined axial position, and a first journal portion which is formed at a tip end portion of the control shaft, which has a diameter smaller than a diameter of the fixing portion, and which is supported by a first bearing hole formed in the support hole.

4 Claims, 8 Drawing Sheets

(56) References Cited

U.S. PATENT DOCUMENTS

| | | | | |
|---|---|---|---|---|
| 9,482,161 | B2 | 11/2016 | Nagai et al. | |
| 2002/0043228 | A1 | 4/2002 | Moteki | |
| 2002/0050252 | A1 | 5/2002 | Moteki | |
| 2005/0211205 | A1 | 9/2005 | Yamada et al. | |
| 2006/0048728 | A1 | 3/2006 | Scalzo | |
| 2008/0223341 | A1 | 9/2008 | Kamada | |
| 2008/0283008 | A1 | 11/2008 | Hiyoshi et al. | |
| 2008/0314356 | A1 | 12/2008 | Kamen et al. | |
| 2013/0306035 | A1* | 11/2013 | Hiyoshi | F02B 75/047 123/48 B |
| 2013/0306036 | A1 | 11/2013 | Hiyoshi et al. | |
| 2013/0327302 | A1 | 12/2013 | Hiyoshi | |
| 2014/0238345 | A1 | 8/2014 | Kamada | |
| 2014/0290625 | A1* | 10/2014 | Hiyoshi | F02B 75/32 123/48 R |
| 2015/0176507 | A1 | 6/2015 | Tanaka et al. | |
| 2015/0204251 | A1* | 7/2015 | Tanaka | F02B 75/048 123/48 R |
| 2015/0219022 | A1* | 8/2015 | Nagai | F02B 75/045 123/48 B |
| 2015/0292400 | A1* | 10/2015 | Hiyoshi | F02B 75/045 123/48 R |
| 2015/0354448 | A1 | 12/2015 | Hiyoshi et al. | |

FOREIGN PATENT DOCUMENTS

| | | | |
|---|---|---|---|
| JP | 2007-085559 | A | 4/2007 |
| JP | 2010-151088 | A | 7/2010 |
| JP | 2011-169152 | A | 9/2011 |
| JP | 2012-251446 | A | 12/2012 |
| WO | WO-2013/080674 | A1 | 6/2013 |
| WO | WO-2014/027497 | A1 | 2/2014 |
| WO | WO-2014/109179 | A1 | 7/2014 |

OTHER PUBLICATIONS

Supplemental Notice of Allowability dated Jul. 28, 2016 as issued in corresponding U.S. Appl. No. 14/613,079.

U.S. Office Action as issued in corresponding U.S. Appl. No. 14/613,035 dated Nov. 21, 2016.

U.S. Notice of Allowance as issued in corresponding U.S. Appl. No. 14/613,035 dated Jun. 14, 2017.

* cited by examiner

ACTUATOR OF VARIABLE COMPRESSION RATIO MECHANISM AND ACTUATOR OF LINK MECHANISM

The present application is a continuation application of U.S. application Ser. No. 14/613,035, filed Feb. 3, 2015, which claims the benefit of priority from Japanese Patent Application No. 2014-018992, filed Feb. 4, 2014; the entire contents of which are incorporated herein by reference.

BACKGROUND OF THE INVENTION

This invention relates to an actuator of a variable compression ratio mechanism arranged to vary a mechanical actual compression ratio of an internal combustion engine, and a link mechanism used for a variable valve actuating apparatus that is arranged to vary operation characteristics of engine valve of an intake valve and/or an exhaust valve.

A Japanese Patent Application Publication No. 2011-169152 discloses a conventional variable compression ratio mechanism which uses multi-link piston-crank mechanism, and which is arranged to vary a mechanical compression ratio and a geometric compression ratio of the internal combustion engine.

That is, a piston and a crank shaft are connected through an upper link and a lower link. A posture of the lower link is controlled by controlling the actuator. With this, the engine compression ratio is controlled.

The actuator includes a housing, a speed reduction device and a drive motor which are mounted to an outside of the housing, and a control shaft (a second control shaft in the above-described patent document) which is inserted within the housing, which are rotatably supported, and to which a rotational force from the speed reduction device is transmitted, and an eccentric shaft portion (a second eccentric shaft portion in the above-described patent document) which is integrally provided to a tip end of the control shaft, and a control link which includes a first end connected to a lower link, and a second end connected to an eccentric shaft portion of the control shaft that extends in parallel with a crank shaft.

A rotation position of the control shaft is varied by the rotational force from the drive motor and the speed reduction device. With this, a posture of the lower link is controlled through the eccentric shaft portion and the control link.

SUMMARY OF THE INVENTION

However, in the conventional variable compression ratio mechanism described in the above-described patent document, the eccentric shaft portion is integrally provided to the tip end of the control shaft. Accordingly, for assembling the control shaft to the housing, it is necessary that the housing includes an insertion hole in which the eccentric shaft portion can be inserted, or that the housing is divided from the upward and downward directions, and the control shaft is supported in a state where the control shaft is sandwiched by the bearing portions of the divided housing from the upward and downward directions. Consequently, the size and the weight of the housing are increased.

It is, therefore, an object of the present invention to provide a link mechanism for a vehicle and an actuator of a variable compression ratio mechanism which is devised to solve the above-described problems, and to avoid a size increase and a weight increase of a housing.

According to one aspect of the present invention, an actuator of a variable compression ratio mechanism arranged to vary at least one of an upper dead center position and a lower dead center position of a piston of an internal combustion engine, and to vary a mechanical compression ratio, the actuator comprises: a control link including a first end portion linked with the piston, and a second end portion, and arranged to vary a position characteristic of the piston; an arm link rotatably connected to the second end portion of the control link; a control shaft which is a member different from the arm link, and to which the arm link is fixed; a housing including a receiving portion in which a connection portion between the second end portion of the control link and the arm link is received, and a support hole formed within the housing, and rotatably supporting the control shaft; and a speed reduction device arranged to reduce a rotation speed of the motor, and to transmit the reduced rotation to the control shaft, the control shaft including a fixing portion inserted and fixed within the receiving portion in a fixing hole formed in the arm link at a predetermined axial position, and a first journal portion which is formed at a tip end portion of the control shaft, which has a diameter smaller than a diameter of the fixing portion, and which is supported by a first bearing hole formed in the support hole.

According to another aspect of the invention, an actuator used for driving a link mechanism, the actuator comprises: a control link including a first end portion connected to the link mechanism, and a second end portion; a control shaft which is rotatably connected to the second end portion of the control link through an arm link; an arm link rotatably connected to the second end portion of the control link; a control shaft which is a member different from the arm link, and to which the arm link is fixed; a housing which includes a receiving portion receiving a connection portion of the second end portion of the control link and the arm link, and which rotatably supports the control shaft passing through the receiving portion; and a speed reduction device arranged to reduce a rotation speed of a drive motor, and to transmit the reduced rotation to the control shaft, the arm link including a fixing hole in which the control shaft is inserted and fixed within the receiving portion.

DETAILED DESCRIPTION OF THE INVENTION

Hereinafter, an actuator of a variable compression ratio mechanism according to embodiments of the present invention is illustrated with reference to the drawings. In this embodiment, there are provided a variable compression ratio mechanism (VCR) arranged to vary a mechanical compression ratio of an in-line four cylinder gasoline internal combustion engine, and an actuator thereof.

First Embodiment

Figure 1:
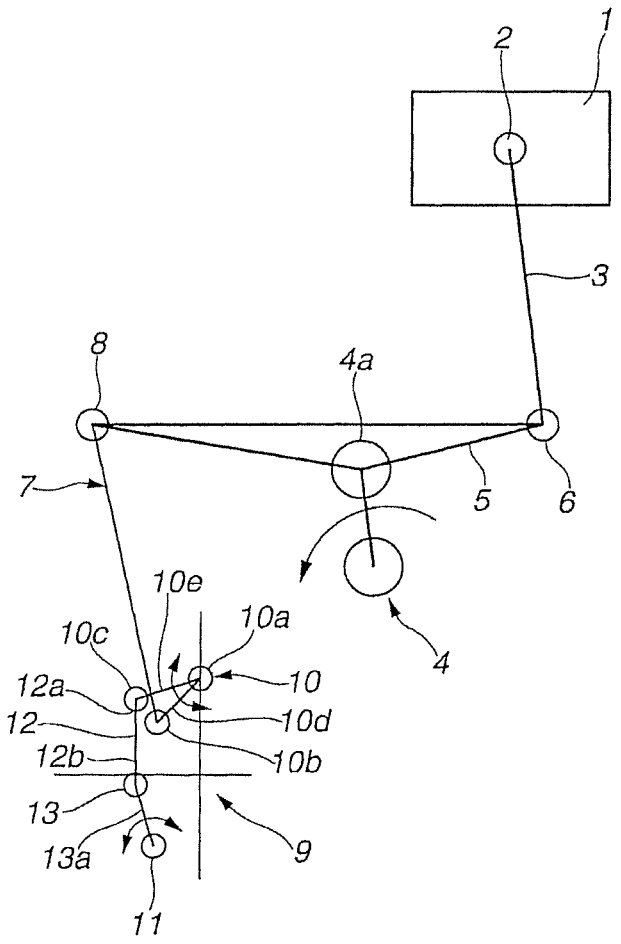
FIG. 1 is a schematic view schematically showing an embodiment according to the present invention.

FIG. 1 schematically shows a variable compression ratio mechanism according to the present invention. This is identical to a structure of FIG. 1 of the conventional art of Japanese Patent Application Publication No. 2011-169152. Accordingly, this is briefly illustrated.

There are provided an upper link 3 including an upper end which is rotatably connected to a piston pin 2 of a piston 1 that reciprocates within a cylinder of a cylinder block of an internal combustion engine; and a lower link 5 which is rotatably connected to a crank pin 4*a* of a crank shaft 4. Lower link 5 is rotatably connected with a lower end of upper link 3 through a connection pin 6. Lower link 5 is rotatably connected to an upper end portion of a first control link 7 through a connection pin 8.

First control link 7 includes a lower end portion connected with a connection mechanism 9 constituted by a plurality of link members. This connection mechanism 9 includes a first control shaft 10; a second control shaft 11 which is a control shaft; and a second control link 12 which is a control link connecting first control shaft 10 and second control shaft 11.

First control shaft 10 extends within the engine in parallel with crank shaft 4 in a cylinder row direction. First control shaft 10 includes a first journal portion 10*a* rotatably supported by a main body of the engine; a plurality of control eccentric shaft portion 10*b* each of which a lower end portion of first control link 7 of the each cylinder is rotatably mounted to; and an eccentric shaft portion 10*c* to which a first end portion 12*a* of second control link 12 is rotatably mounted.

Each of control eccentric shaft portions 10*b* is provided through first arm portion 10*d* at a position which is eccentric (depart) from first journal portion 10*a* by a predetermined amount. Similarly, eccentric shaft portion 10*c* is provided through second arm portion 10*e* at a position which is eccentric from first journal portion 10*a* by a predetermined amount.

Second control shaft 11 is rotatably supported within a housing 20 (described later) through a plurality of journal portions. An arm link 13 is connected and fixed to the second control shaft 11. Arm link 13 is rotatably connected with second end portion 12*b* of second control link 12.

Figure 2:
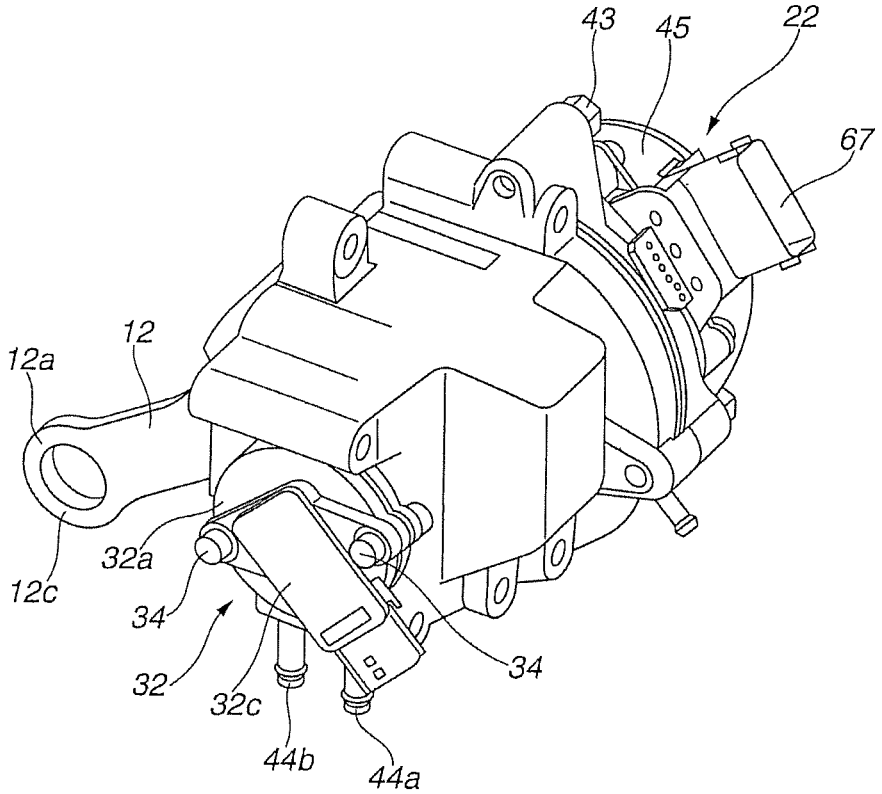
FIG. 2 is a perspective view showing an actuator of a variable compression ratio mechanism according to the present invention.
Figure 3:
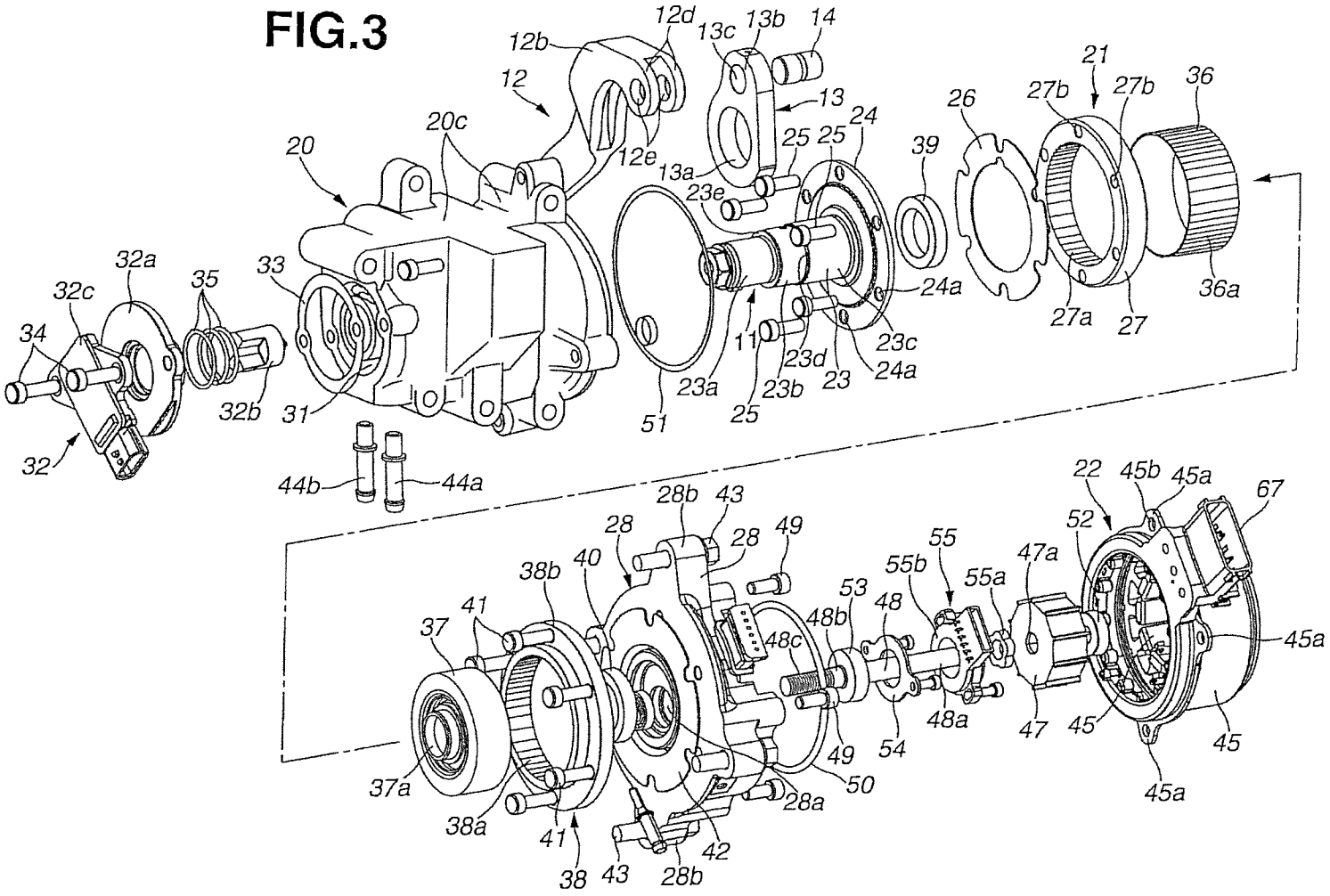
FIG. 3 is an exploded perspective view showing the actuator in the first embodiment.
Figure 4:
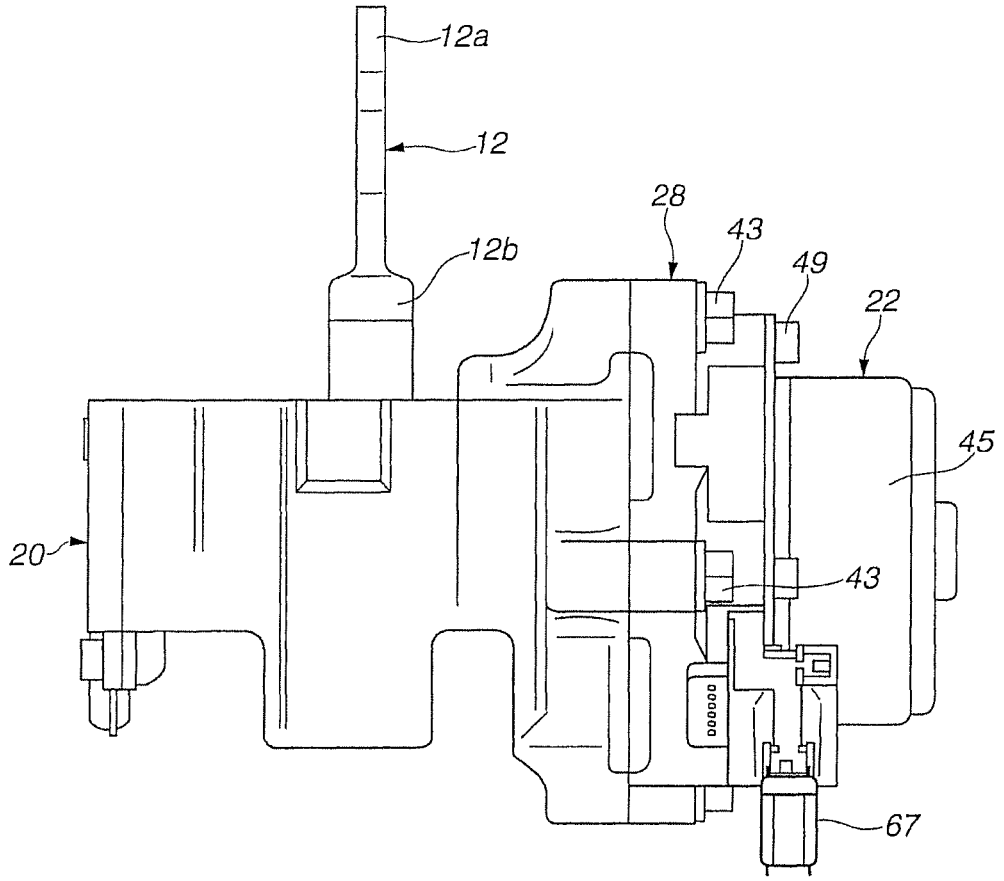
FIG. 4 is a plan view showing the actuator.
Figure 5:
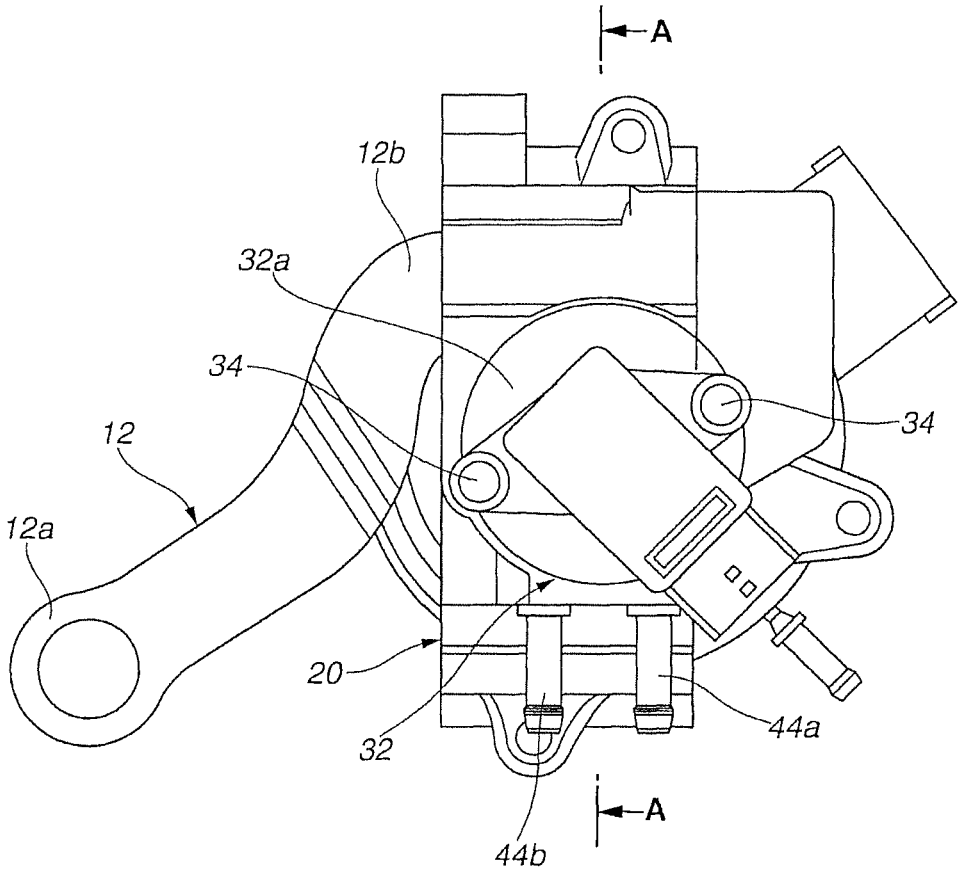
FIG. 5 is a left side view of the actuator.

As shown in FIGS. 2 and 3, second control link 12 has a lever shape. Second control link 12 includes first end portion 12*a* which has a substantially straight shape, and to which eccentric shaft portion 10*c* is connected; and a second end portion 12*b* which has a substantially arc (curved) shape by bending, and to which arm link 13 is connected. First end portion 12*a* of second control link 12 includes an insertion hole 12*c* which is formed at a tip end portion of first end portion 12*a*, which penetrates through first end portion 12*a*, and through which eccentric shaft portion 10*c* is rotatably inserted. On the other hand, second end portion 12*b* of second control link 12 includes tip end portions 12*d* and 12*d* which are formed into a bifurcated shape (two-forked shape). A protrusion portion 13*b* (described later) of arm link 13 is sandwiched and held between tip end portions 12*d* and 12*d* of second end portion 12*b*. Moreover, second end portion 12*b* includes fixing holes 12*e* and 12*e* which penetrate through second end portion 12*b*, and which a connection pin 14 connected with protrusion portion 13*a* is fit and fixed in.

Arm link 13 is formed independently of second control shaft 11. Arm link 13 is formed from an iron series metal into an annular shape having a large thickness. Arm link 13 includes a press-fit hole 13*a* which is formed in a substantially central portion of arm link 13, and which is fit and fixed on a fixing portion formed between the front and rear journal portions of second control shaft 11; and a protrusion portion 13*b* which has a U-shape, which is formed on an outer circumference of arm link 13, and which protrudes in the radial direction. Press-fit hole 13*a* and protrusion portion 13*b* are integrally formed to constitute arm link 13. This protrusion portion 13*b* includes a connection hole 13*c* in which connection pin 14 is rotatably supported. A shaft center (connection pin 14) of this connection hole 13*c* is eccentric from the shaft center of second control shaft 11 in the radial direction through protrusion portion 13*b*.

Second control shaft 11 is arranged to vary a rotational position by a torque (rotational force) transmitted from a drive motor 22 through a speed reduction device 21 which is a part of the actuator, thereby to rotate control shaft 10 through second control link 12, and to move a position of the lower end portion of first control link 7. With this, a posture of lower link 5 is varied so that the stroke characteristic of piston 1 is varied. Consequently, the engine compression ratio is varied in accordance with the variation of the stroke characteristic of piston 1.

As shown in FIG. 2 to FIG. 7, the actuator includes second control shaft 11; a housing 20 rotatably supporting second control shaft 11 within housing 20; speed reduction device 21 provided within a rear end side portion of housing 20; and drive motor 22 provided on a rear end side of speed reduction device 21.

Second control shaft 11 includes a shaft main body 23 which is integrally made from an iron series metal; and a fixing flange 24 provided integrally with a rear end portion of shaft main body 23. Shaft main body 23 is formed into a stepped shape in an axial direction. Shaft main body 23 includes a first journal portion 23*a* which is on a tip end side, and which has a small diameter; a fixing portion 23*b* which has a middle diameter, which is located at an intermediate portion, and to which arm link 13 is fit from first journal portion 23*a*'s side through press-fit hole 13*a*; and a second journal portion 23*c* which has a large diameter, and which is on the fixing flange 24's side. Moreover, shaft main body 23 includes a first stepped portion 23*d* located between fixing portion 23*b* and second journal portion 23*c*; and a second stepped portion 23*e* located between first journal portion 23*a* and fixing portion 23*b*.

First stepped portion 23*d* includes one end side hole edge which is on the second journal portion 23*c*'s side. When press-fit hole 13*a* of arm link 13 is fit on fixing portion 23*b* from the first journal portion 23*a*'s side, this one end side hole edge of first stepped portion 23*d* is abutted in the axial direction. With this, first stepped portion 23*d* restricts the movement of arm link 13 in a direction toward the second journal portion 23*c*. On the other hand, when shaft main body 23 is inserted within support hole 30, second stepped portion 23*e* is abutted on a stepped hole edge 30*c* (described later) of support hole 30 so as to restrict a movement in the axial direction.

Fixing flange 24 includes six bolt insertion holes 24*a* which are formed in an outer circumference portion of fixing flange 24 at a regular interval in the circumferential direction, and which penetrate through fixing flange 24. Fixing flange 24 is connected through a thrust plate 26 to a circular spline 27 which is an internal gear of speed reduction device 21, by the six bolts 25 inserted though the bolt insertion holes 24*a*.

Housing 20 is made from aluminum alloy. Housing 20 has a substantially cube shape. Housing 20 includes an opening groove portion 20*a* which is located on a rear end side, which has a large diameter, which has a circular shape, and which is closed through an O-ring 51 by a cover 28. Moreover, housing 20 includes a flat first side surface 20*b*; and a receiving chamber 29 which is a receiving portion extending within housing 20 from first side surface 20*b* in a lateral direction. Furthermore, housing 20 includes a support hole 30 which extends within housing 20 from a bottom surface of opening groove portion 20*a* in the axial direction, and in which shaft main body 23 is inserted and disposed, and which penetrates through housing 20 in a direction perpendicular to receiving chamber 29.

Moreover, there is provided a holding hole 31 extending from support hole 30 in the axial direction. The holding hole 31 receives an angle sensor 32 which is arranged to sense a rotational angle position of control shaft 13.

Furthermore, housing 20 is connected with a coolant water pipes 44*a* and 44*b* which are arranged to supply and discharge the coolant water cooling angle sensor 32, into and from housing 20.

Cover 28 includes a motor shaft insertion hole 28*a* which is located at a substantially central position of cover 28, and which penetrates through cover 28; four boss portions which protrudes from an outer circumference surface of cover 28 in the radial direction; and bolt insertion holes which are formed in the boss portions 28, which penetrates through the boss portions 28, and into which four bolts 43 are inserted from the drive motor 22's side. Cover 28 is fixed to housing 20 by four bolts 43.

Figure 6:
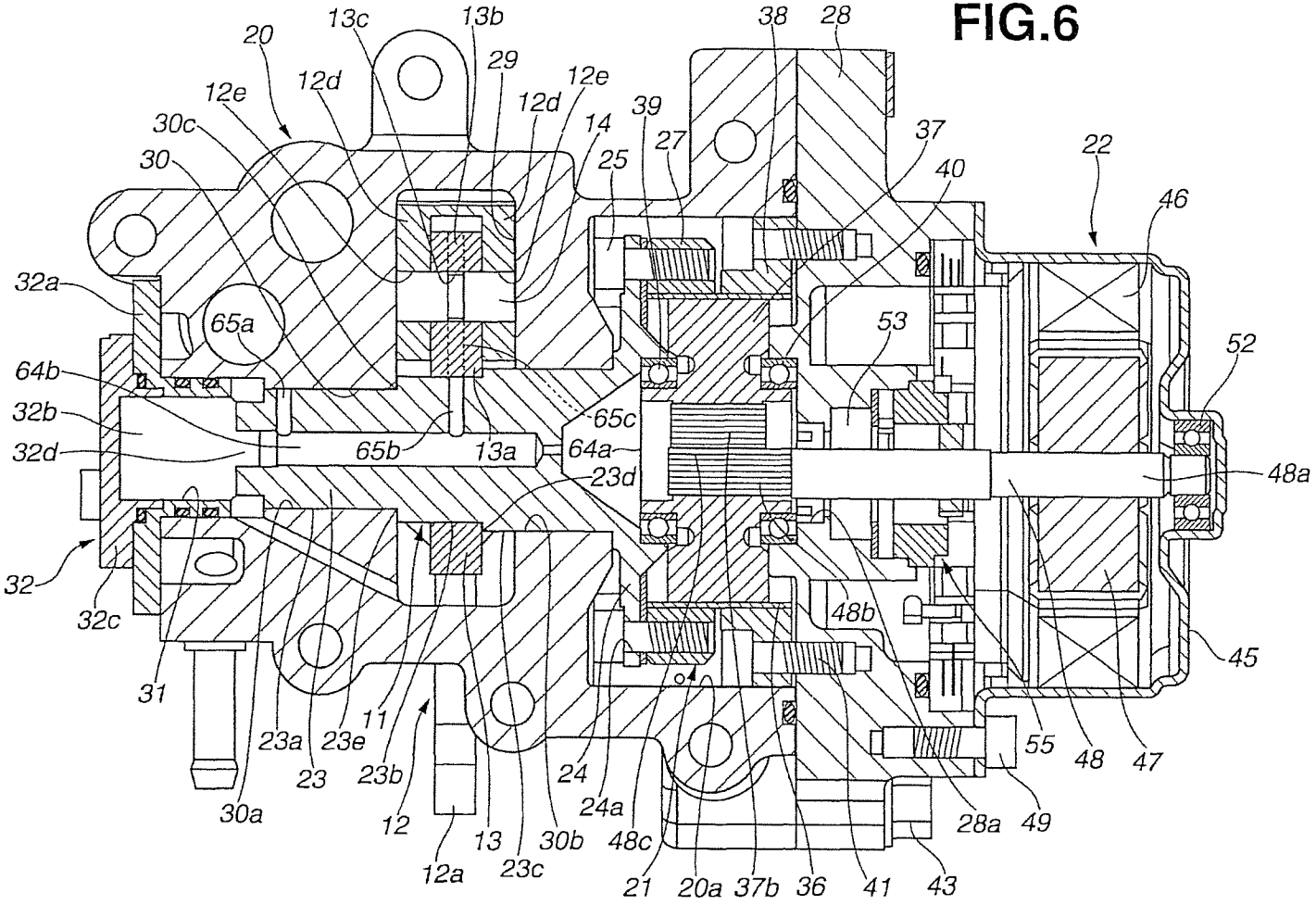
FIG. 6 is a longitudinal sectional view of the actuator.
Figure 7:
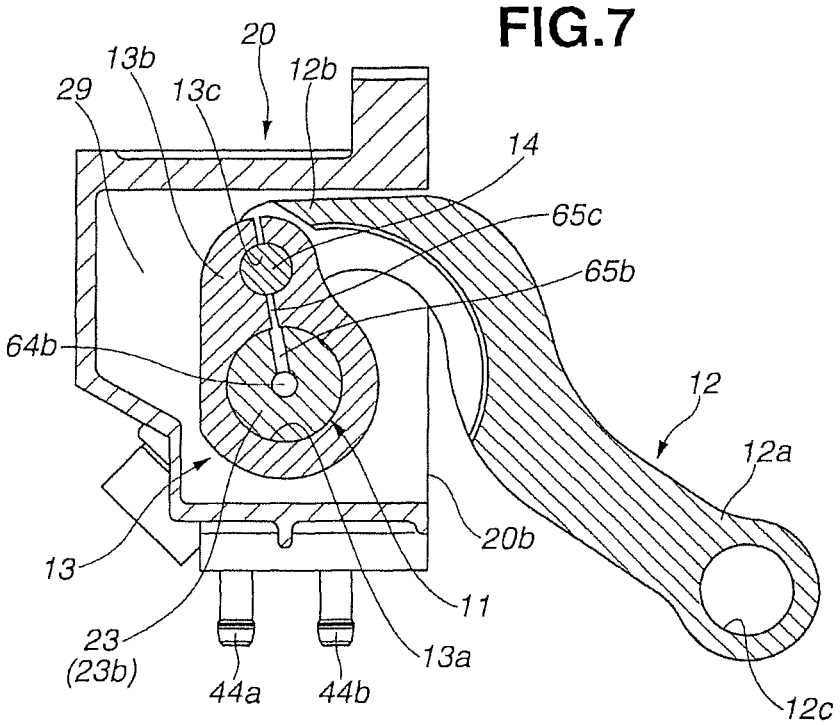
FIG. 7 is a sectional view showing a main part in the first embodiment.

As shown in FIG. 6 and FIG. 7, receiving chamber 29 receives a connection portion between second end portion 12*b* of control link 12 and arm link 13 by connection pin 14. Accordingly, receiving chamber 29 has an entire space to ensure the free swing movements of control link 12 and arm link 13. Moreover, receiving chamber 29 has a width slightly longer than a width of second end portion 12*b* of control link 12 to suppress the backlash at the operation.

As shown in FIG. 6, support hole 30 has a stepped shape so that an outside diameter of an inner circumference surface of support hole 30 corresponds to an outside diameter of shaft main body 23 of second control shaft 11. Support hole 30 includes a first bearing hole 30*a* which has a small diameter, and in which first journal portion 23*a* is supported; a position corresponding to the position of fixing portion 23*b*, that is, a portion opened to receiving chamber 29; and a second bearing hole 30*b* which has a large diameter, and in which second journal portion 23*c* is supported.

First bearing hole 30*a* includes a stepped hole edge 30*c* which confronts receiving chamber 29, and which is arranged to abutted on second stepped portion 23*e* in the axial direction when second shaft main body 23 is inserted into support hole 30, and to restrict the further insertion of second shaft main body 23. Besides, the maximum insertion movement position restriction with respect to support hole 30 of shaft main body 23 is also restricted by abutting the inner circumference portion of fixing flange 24 on the outer hole edge of second bearing hole 30*b*.

As shown in FIG. 2 and FIG. 3, angle sensor 32 includes a sensor cover 32*a* which is a cap shape, and which is fixed on the inner circumference surface of holding hole 31 by the press-fit; a rotor 32*b* which is for sensing the angle, and which is disposed on the inner circumference side of the center cover 32*a*; and a sensor portion 32*c* which is provided at a substantially central portion of sensor cover 32*a*, and which is arranged to sense the rotational position of rotor 32*b*. Sensor portion 32*c* is arranged to output the sensed signal to a control unit (not shown) configured to sense an operating state of the engine. Rotor 32*b* includes a tip end portion protrusion portion 32*d* fixed in a fixing hole that is located on the tip end side of the shaft main body 23.

A portion between sensor cover 32*a* and holding hole 31 is sealed by a gasket 33. Sensor cover 32*a* is mounted together with sensor portion 32*c* to housing 20 by two bolts 34. Moreover, three O-rings 35 are provided on an outer circumference of a cylindrical portion of sensor cover 32*a*, so as to restrict the insertion of the oil in a direction toward sensor portion 32*c*.

Speed reduction device 21 is a harmonic drive type (registered trademark). Constituting components of speed reduction device 21 is received within opening groove portion 20*a* of housing 20 which is closed by cover 28. That is, speed reduction device 21 includes a first circular spline 27 which is an annular shape, which is fixed to fixing flange 24 of shaft main body 23 by bolts, and which includes an inner circumference on which a plurality of internal teeth 27*a* are formed; a flex spline 36 which is disposed inside first circular spline 27, which is an external gear that includes an outer circumference surface having a plurality of external teeth 36*a* engaged with internal teeth 27*a*, and which can flexibly vary shape thereof; a wave generator (wave generation device) 37 including an outer circumference surface which has an oval shape, and which is slid on a part of the inner circumference surface of flex spline 36; and a second circular spline 38 which is disposed on the outer circumference side of flex spline 36, and which includes an inner circumference surface formed with an inner teeth 38*a* engaged with the external teeth 36*a*.

First circular spline 27 includes six internal screw holes 27*b* which are formed at a regular internal in the circumferential direction, and in which bolts 25 are respectively screwed.

Flex spline 36 is made from metal material. Flex spline 36 is formed into a thin cylindrical shape which can flexibly vary shape thereof. A number of the teeth of external teeth 36*a* is greater than a number of the teeth of internal teeth 27*a* of first circular spline 27 by one.

Wave generator 37 includes a through hole 37*a* which has a relatively large diameter, and which is formed into a substantially circular shape at a substantially central portion of wave generator 37; and a plurality of internal teeth 37*b* which are formed on an inner circumference surface of through hole 37*a*. Moreover, this wave generator 37 includes a cylindrical portion protruding from front and rear hole edges of through hole 37*a* in the axial direction. Wave generator 37 is rotatably supported by this cylindrical portion and front and rear ball bearings 39 and 40 which are provided between fixing flange 24 and wave generator 37, and between wave generator 37 and cover 28. Furthermore, the oval outer circumference surface of wave generator 37 is formed into a flat shape. The oval outer circumference surface of wave generator 37 is abutted and slid on a flat inner circumference of flex spline 36.

Second circular spline 38 includes a flange portion 38*b* which is located on an outer circumference of second circular spline 38; and six bolt insertion holes which penetrate through second circular spline 38. Second circular spline 38 is fixed through a second thrust plate 42 on an inner end portion of cover 28 by six bolts inserted through the bolt insertion holes of second circular spline 38. Moreover, this second circular spline 38 includes internal teeth 38*a* having a number of the teeth which is identical to the number of the teeth of external teeth 36*a* of flex spline 36. Accordingly, the number of the teeth of internal teeth 38*a* of second circular spline 38 is greater than a number of teeth of internal teeth 27*a* of first circular spline 27 by one. The speed reduction ratio is determined by this difference of the number of the teeth.

Drive motor 22 is a brushless electric motor. As shown in FIG. 3 and FIG. 6, drive motor 22 includes a motor casing 45 which has a bottomed cylindrical shape; a cylindrical coil 46 which is fixed on an inner circumference surface of motor casing 45; a magnetic rotor 47 which is rotatably provided within coil 46; and a motor shaft 48 which includes a first end portion 48*a* fixed to a substantially axial center portion of magnetic rotor 47.

Motor casing 45 include four boss portions 45*a* formed on an outer circumference of an front end of motor casing 45; and bolt insertion holes 45*b* which are formed, respectively, in four boss portions 45*a*. Motor casing 45 is mounted through an O-ring 50 to a rear end portion of cover 28 by four bolts 49 inserted into bolt insertion holes 45*b*. Moreover, a connector portion 67 is integrally provided with an outer circumference of motor casing 45. Connector portion 67 is arranged to receive a control current from the control unit.

The magnetic rotor 47 includes an outer circumference on which positive magnetic poles and negative magnetic poles are alternately disposed in the circumferential direction. Moreover, magnetic rotor 47 include a fixing hole 47*a* which is located at a substantially axial central portion, which penetrates through magnetic rotor 47, and into which first end portion 48*a* of motor shaft 48 is inserted by the press-fit.

Motor shaft 48 includes a first end portion 48*a* which protrudes from one end surface of magnetic rotor 47, and which has a tip end portion supported by a ball bearing 52 whose an outer wheel is fixed within an end wall of motor casing 4; and a second end portion 48*b* which is supported by a ball bearing 53 whose an outer wheel is fixed on an inner circumference of motor shaft insertion hole 28*a* of cover 28. Furthermore, motor shaft 48 includes external teeth 48*c* which is formed on an outer circumference surface of second end portion 48*b*, and which is engaged with internal teeth 37*b* of wave generator 37.

Ball bearing 53 is held within the holding groove of cover 28 through a substantially disc shaped retainer 54 by screws 55.

A resolver 55 is disposed at a substantially central position of motor shaft 48 in the axial direction. Resolver 54 is arranged to sense a rotation angle of motor shaft 48. This resolver 55 includes a resolver rotor 55*a* which is fixed on the outer circumference of motor shaft 48 by the press-fit; and a sensor portion 55*b* which is arranged to sense a target which has a compound leaf shape, and which is formed on an outer circumference surface of resolver rotor 55*a*. This sensor portion 55*b* is fixed inside cover 28 by two screws 56. Moreover, this sensor portion 55*b* is arranged to output a sensing signal to the control unit.

Second control shaft 11 includes an introduction portion which extends within second control shaft 11 in the axial direction, and which is arranged to introduce the lubrication oil pressurized and transmitted by an oil pump (not shown); and a plurality of radial holes 65*a* and 65*b* connected with this introduction portion. That is, introduction portion includes an oil chamber 64*a* which has a substantially conical shape, which is formed at a substantially central portion of fixing flange 24, and to which the lubrication oil is supplied from an oil hole (not shown); and an axial hole 64*b* which extends within second control shaft 11 from oil chamber 64*a* in axial center direction of second control shaft 11.

The one radial hole 65*a* includes an inner end which is opened on a tip end portion of axial hole 64*b*; and an outer end which is opened on a clearance between the outer circumference surface of first journal portion 23*a* and first bearing hole 30*a*. The one radial hole 65*b* supplies the lubrication oil to this (the inner end and the outer end). As shown in FIG. 7, the other radial hole 65*b* is connected with an oil hole 65*c* formed inside arm link 13. The other radial hole 65*b* is arranged to supply the lubrication oil through this oil hole 65*c* to a portion between the inner circumference surface of connection hole 13 and the outer circumference surface of connection pin 14.

Operations of this Embodiment

Figure 8:
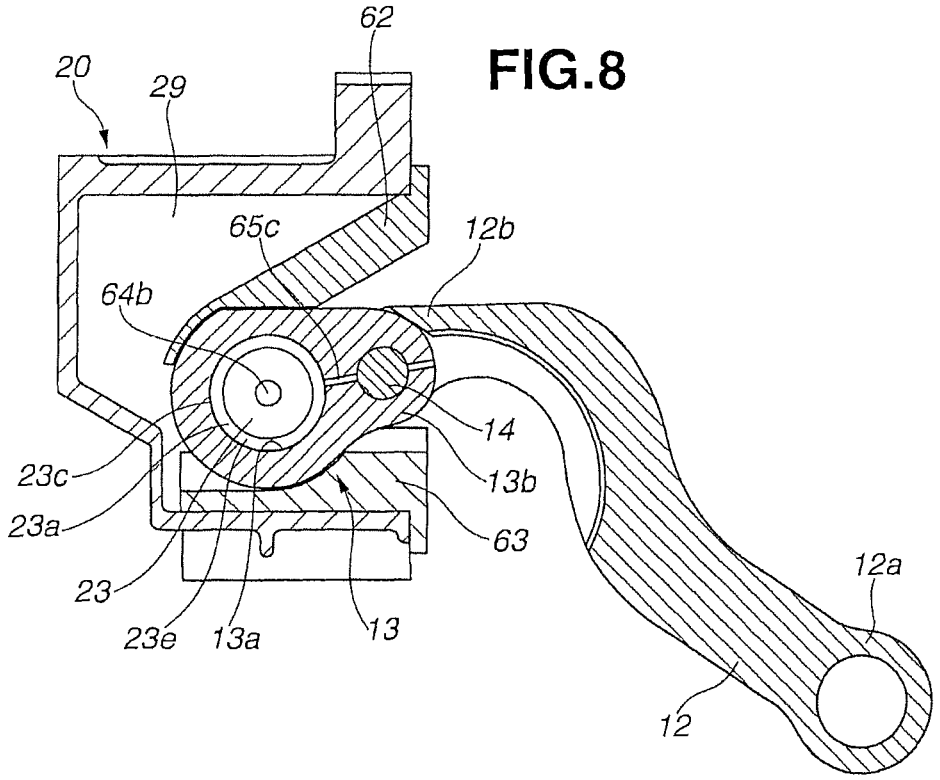
FIG. 8 is a sectional view showing a state in which a control shaft is assembled to a control shaft in the first embodiment.

By the above-describe configuration according to the embodiment, when arm link 13 is fixed within to shaft main body 23 of second control shaft 11 by the press-fit, first, as shown in FIG. 8, in a state where second end portion 12*b* of control link 12 and protrusion portion 13*b* of arm link 13 are previously connected by a connection pin 14, this connection portion is received, positioned, and fixed within receiving chamber 29 by two jigs 62 and 63. In this state, shaft main body 13*a* is inserted into press-fit hole 13*a* from the tip end portion (first journal portion 23*a*)'s side. The outer circumference surface of fixing portion 23*b* is press-fit in the axial direction until first stepped portion 23*d* is abutted on the one end side hole edge.

Then, by detaching jigs 62 and 63, the assembling operation of arm link 13 with respect to second control shaft 11 is finished.

In this way, in this embodiment, second control shaft 11 and arm link 13 are divided. Arm link 13 is connected within receiving chamber 29 to shaft main body 23. Accordingly, unlike the conventional art in which the shaft main body 23 and arm link 13 are integrally formed, it is unnecessary that the inside diameter of motor shaft insertion hole 30 of housing 20 is set to a large diameter for inserting arm link 13. Moreover, it is utterly unnecessary that housing 20 is divided into upper and lower sections.

Accordingly, it is possible to suppress the increase of the overall size of housing 20, and to improve the size reduction and the weight reduction of housing 20. Consequently, it is possible to improve the mountability of the variable compression ratio mechanism to the engine.

Moreover, the second control shaft 11 and arm link 13 are different members. Accordingly, it is possible to improve the freedom of the length of arm link 13, and to set to a long length in accordance with the size of receiving chamber 29. Consequently, it is possible to decrease a reverse input load from control link 12 to the second control shaft 11's side. Therefore, it is possible to decrease the loads of speed reduction device 21 and drive motor 22.

Shaft main body 23 has a stepped shape from a second journal portion 23*c* having a maximum diameter, through a fixing portion 23*b* having a middle diameter, to a first journal portion 23*a* having a minimum diameter. Accordingly, it is possible to improve the insertion operation into support hole 30.

Moreover, arm link 13 is fixed through press-fit hole 13*a* to fixing portion 23*b* of shaft main body 23 in the axial direction by the press-fit. Accordingly, it is possible to ease the connection operation between the arm link 13 and shaft main body 23.

Moreover, second stepped portion 23*e* of shaft main body 23 is abutted on stepped hole edge 30*c* of support hole 30. With this, it is possible to ease the positioning of shaft main body 23*d* in the axial direction at the insertion of shaft main body 23. Furthermore, it is possible to restrict the position of arm link 13 in the axial direction at the press-fit by using first stepped portion 23*d* of shaft main body 23. Accordingly, it is possible to ease the positioning at this point.

Shaft main body 23 is supported by front and rear first and second bearing holes 30*a* and 30*b* of support hole 30 through front and rear first and second journal portions 23*a* and 23*c*. Accordingly, it is possible to constantly stably support second control shaft 11.

Moreover, shaft main body 23 of second control shaft 11 is made from iron series metal. On the other hand, the entire of housing 20 including first and second bearing holes 30*a* and 30*b* are formed from aluminum alloy. With this, difference between the iron and the aluminum alloy by thermal expansion and contraction becomes small since the first bearing hole 30*a* has a small diameter shape. With this, it is possible to suppress the generation of the twist due to the backlash between first journal portion 23*a* and first bearing hole 30*a*.

Second Embodiment

Figure 9:
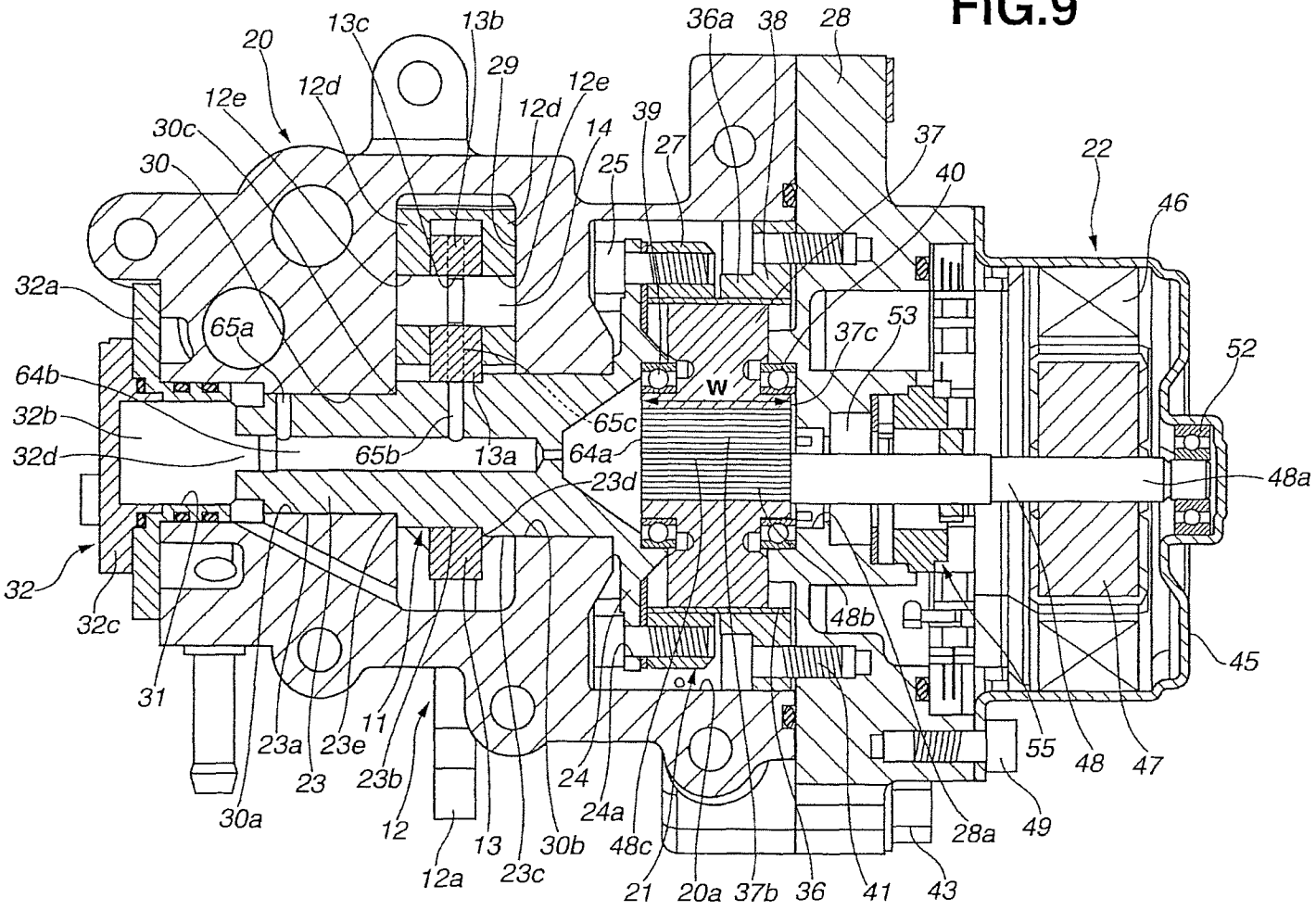
FIG. 9 is a longitudinal sectional view showing an actuator according to a second embodiment of the present invention.

FIG. 9 is a view showing a second embodiment of the present invention. Second embodiment has a basic structure identical to that of the first embodiment. Unlike the first embodiment, the structure of wave generator 37 is varied.

That is, wave generator 37 has the axial width of the outer circumference portion which is identical to that of the first embodiment. However, wave generator 37 includes an inner circumference portion 37*c* to which the front and rear ball bearings 39 and 40 are mounted. This inner circumference portion 37*c* of wave generator 37 has an entire axial width W which is longer than that of the first embodiment. Moreover, internal teeth 37*b* formed on the through hole 37*a* of inner circumference portion 37*c* has an axial length which is longer than that of the first embodiment. On the other hand, second end portion 48*b* of motor shaft 48 has a long axial length according to inner circumference portion 37*c*. Moreover, the axial length of external teeth 48*c* is lengthened.

Accordingly, in this embodiment, a width of the engagement between external teeth 48*c* of motor shaft 48 and internal teeth 37*b* of wave generator 37 becomes large. Consequently, it is possible to stably transmit the torque (rotational force) of motor shaft 48.

In this embodiment, the other configuration in which shaft main body 23 and arm link 13 are divided is identical to that of the first embodiment. Accordingly, it is possible to attain the same operations and functions.

The present invention is not limited to the configuration of the embodiments. For example, spline connection (joint) and bolt joint may be employed as the fixing means of arm link 13 with respect to shaft main body 13, in addition to the press-fit.

Moreover, the present invention is applicable to actuators of other link mechanisms for the vehicle, in addition of the actuator of the variable compression ratio mechanism. For example, the present invention is applicable to an actuator of an operation angle variable mechanism which is a variable valve actuating device arranged to vary an operation angle of a valve of an internal combustion engine by an operation of a link mechanism.

In the actuator of the variable compression ratio mechanism according to the embodiments of the present invention, the control link includes a stepped portion formed between the second bearing hole and the fixing portion; and the arm link includes a first end portion arranged to be restricted to be moved in the axial direction by the stepped portion.

By this invention, the arm link is positioned in the axial direction by the stepped portion. Accordingly, it is possible to ease the assembly operation.

[b] In the actuator of the variable compression ratio mechanism according to the embodiments of the present invention, the control shaft is made from iron series metal; and an entire of the housing including the first bearing hole and the second bearing hole is made from aluminum alloy.

By this invention, the housing is made from the aluminum alloy. Accordingly, it is possible to attain the weight reduction. Moreover, the first bearing hole has the small diameter. Consequently, the difference between the iron and the aluminum alloy becomes small by the thermal expansion and constriction. Therefore, it is possible to suppress the twist of the backlash of the first bearing hole.

[c] In the actuator of the variable compression ratio mechanism according to the embodiments of the present invention, the control link includes a first end portion which is rotatably connected through a connection pin inserted into a connection hole formed in a second end portion of the arm link.

[d] In the actuator of the variable compression ratio mechanism according to the embodiments of the present invention, the speed reduction device is a harmonic drive type (registered trademark). The speed reduction device is integrally fixed to the control shaft. The speed reduction device includes an inner gear which has an inner circumference formed with an internal teeth, and which has an exact circle shape, and an outer gear which flexibly varies its shape, which is disposed on the inner circumference side of the inner gear, and which includes an outer circumference formed with an external teeth which is engaged with the internal teeth, which is engaged with the internal teeth, and whose the number of the teeth is smaller than the number of the teeth; and a wave generation device that has an oval outer circumference surface on which an inner circumference surface of the outer gear is abutted, and that is arranged to abut the outer gear on the inner gear by the rotation of the motor.

[e] In the actuator of the variable compression ratio mechanism according to the embodiments of the present invention, the receiving portion of the housing includes an opening portion opened to the outside.

[f] In the actuator of the variable compression ratio mechanism according to the embodiments of the present invention, the support hole formed inside the housing is formed in a direction crossing the receiving portion.

[g] In the actuator of the variable compression ratio mechanism according to the embodiments of the present invention, the control shaft is inserted into the support hole is after the arm link is received within the receiving portion, so that the journal portion is disposed within the bearing hole.

By this invention, it is possible to integrally form the housing by forming the receiving portion and the support hole without dividing the housing.

[h] In the actuator of the variable compression ratio mechanism according to the embodiments of the present invention, the fixing portion of the control shaft is fixed in the fixing hole of the arm link when the control shaft is inserted in the support hole.

[i] In the actuator of the variable compression ratio mechanism according to the embodiments of the present invention, the control shaft include a stepped surface formed between the fixing portion and the first journal portion on a tip end side; and the stepped surface of the control shaft is abutted on a hole edge portion formed between the receiving portion of the housing and the first bearing hole, so as to restrict an axial position of the control shaft.

By this invention, it is possible to position the control shaft with respect to the support hole of the housing in the axial direction. Accordingly, it is possible to improve the assembly operation of the control shaft.

[j] In the actuator of the variable compression ratio mechanism according to the embodiments of the present invention, the actuator further includes an angle sensor disposed on the first bearing hole's side of the support hole, and arranged to sense a rotation angle of the control shaft.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An actuator of a variable compression ratio mechanism arranged to vary at least one of an upper dead center position and a lower dead center position of a piston of an internal combustion engine, and to vary a mechanical compression ratio, the actuator comprising:

a drive motor;

a control shaft arranged to be rotated by the drive motor;

an arm link including a fixing hole, the control shaft being (i) press-fitted so as to be fixed in the fixing hole, and (ii) aligned so as to be co-axial with the fixing hole, the arm link being arranged to transmit a driving force of the control shaft to the variable compression ratio mechanism; and a housing including a receiving portion that receives a section in which the arm link is fixed to the control shaft, and that is opened in a radial direction of the control shaft, and a support hole that is opened to the receiving portion, and that rotatably supports the control shaft.

2. The actuator for the variable compression ratio mechanism as claimed in claim 1, wherein the actuator further comprises a speed reduction device which is arranged to reduce a rotation speed of the drive motor, and to transmit the speed-reduced rotation to the control shaft; and the speed reduction device includes an inner gear which has a circular shape, which is fixed to the control shaft, and which includes an inner circumference having internal teeth, an outer gear which is arranged to be flexibly varied, which is disposed radially inside the inner gear, which includes an outer circumference having external teeth structured to engage with the internal teeth, a number of the external teeth being smaller than a number of the internal teeth, and a wave generation device that has an oval outer circumference surface on which an inner circumference surface of the outer gear is abutted, and that is arranged to abut the outer gear on the inner gear by the rotation of the motor.

3. An actuator for a variable compression ratio mechanism arranged to vary at least one of an upper dead center position and a lower dead center position of a piston of an internal combustion engine, and to vary a mechanical compression ratio, the actuator comprising:

a drive motor;

a control shaft arranged to be rotated by the drive motor;

an arm link including a fixing hole to which the control shaft is fixed by a press-fit, the arm link being arranged to transmit a driving force of the control shaft to the variable compression ratio mechanism; and a housing including a receiving portion that receives a section in which the arm link is fixed to the control shaft, and that is opened in a radial direction of the control shaft, and a support hole that is opened to the receiving portion, and that rotatably supports the control shaft, wherein the actuator further comprises a speed reduction device which is arranged to reduce a rotation speed of the drive motor, and to transmit the speed-reduced rotation to the control shaft;

the speed reduction device includes an inner gear which has a circular shape, which is fixed to the control shaft, and which includes an inner circumference having internal teeth, an outer gear which is arranged to be flexibly varied, which is disposed radially inside the inner gear, which includes an outer circumference having external teeth structured to engage with the internal teeth, a number of the external teeth being smaller than a number of the internal teeth, and a wave generation device that has an oval outer circumference surface on which an inner circumference surface of the outer gear is abutted, and that is arranged to abut the outer gear on the inner gear by the rotation of the motor;

the control shaft includes a fixing flange integrally provided to an end portion of the control shaft; and the fixing flange is fixed to the inner gear.

4. The actuator for the variable compression ratio mechanism as claimed in claim 3, wherein the fixing flange is arranged to be abutted on a hole edge of the support hole.

* * * * *